US007784899B2

(12) United States Patent
Shimazaki

(10) Patent No.: US 7,784,899 B2
(45) Date of Patent: Aug. 31, 2010

(54) LIQUID EJECTING APPARATUS AND METHOD FOR FLUSHING LIQUID EJECTING APPARATUS

(75) Inventor: Jun Shimazaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 12/021,935

(22) Filed: Jan. 29, 2008

(65) Prior Publication Data

US 2008/0180483 A1 Jul. 31, 2008

(30) Foreign Application Priority Data

Jan. 31, 2007 (JP) ..... 2007-020881

(51) Int. Cl.
*B41J 2/175* (2006.01)

(52) U.S. Cl. ..... 347/23

(58) Field of Classification Search ..... 347/22, 347/23, 35

See application file for complete search history.

(56) References Cited

U.S. PATENT DOCUMENTS

2008/0180482 A1* 7/2008 Shimazaki ..... 347/23

FOREIGN PATENT DOCUMENTS

| | | |
|---|---|---|
| JP | 2005-193393 | 7/2005 |
| JP | 2005-246975 | 9/2005 |
| JP | 2006-123499 | 5/2006 |
| JP | 2006-142554 | 6/2006 |
| JP | 2006-264243 | 10/2006 |
| JP | 2006-272633 | 10/2006 |
| JP | 2007-160671 | * 6/2007 |

* cited by examiner

*Primary Examiner*—Huan H Tran
(74) *Attorney, Agent, or Firm*—Workman Nydegger

(57) ABSTRACT

The invention provides a method for flushing a liquid ejecting apparatus by ejecting liquid from a nozzle of a liquid ejecting head toward a liquid catcher that is provided opposite to a nozzle opening surface of the liquid ejecting head. The method comprises applying an electric field between the nozzle opening surface and the liquid catcher, ejecting the liquid from the nozzle toward the liquid catcher, detecting a change in voltage that is attributable to electrostatic induction generated when the liquid is ejected toward the liquid catcher, and determining whether to continue or discontinue the ejection of the liquid based on the change in voltage.

18 Claims, 9 Drawing Sheets

LIQUID EJECTING APPARATUS AND METHOD FOR FLUSHING LIQUID EJECTING APPARATUS

BACKGROUND

The entire disclosure of Japanese Patent Application No. 2007-020881, filed Jan. 31, 2007 is expressly incorporated herein by reference.

1. Technical Field

The present invention relates to a flushing method that may be used in a liquid ejecting apparatus such as an ink-jet printer and the like. More specifically, the present invention to a flushing method that senses when the nozzles of the liquid ejecting apparatus have become sufficiently unclogged.

2. Related Art

A liquid ejecting apparatus includes a liquid ejecting head that is capable of ejecting liquid in the form of liquid drops. Using this configuration, a liquid ejecting apparatus is capable of ejecting various kinds of liquid from its liquid ejecting head. One example of a liquid ejecting apparatus is an image recording apparatus such as an ink-jet printer, although there are other types of liquid ejecting apparatuses. An ink-jet printer performs a recording process by discharging liquid in the form of ink drops from nozzles that are provided on the recording head toward an ink discharge target medium or target object such as recording paper or the like. When the discharged ink drops land on the surface of the ink discharge target medium, dots are formed, forming an image.

In addition to the image recording apparatus mentioned above, there are various other types of liquid ejecting apparatuses used in the art today including a those used to produce the color filters of liquid crystal display devices.

A typical image recording apparatus stores ink in a liquid reservoir, such as an ink tank, ink cartridge, or the like. As the ink enters a pressure generation chamber in the recording head, a driving signal is applied to a pressure generation source, such as a piezoelectric vibration element or the like, causing a pressure change to the ink contained in the pressure generation chamber. The pressurized ink then is discharged from the apparatus as ink drops from a plurality of nozzles. Thus, the liquid is ejected by controlling the pressure of the recording head. Moreover, the recording head is configured to increase or decrease the amount of liquid (i.e., weight and volume) discharged as ink drops from the nozzles by varying the driving voltage, that is, by controlling the electric potential difference between the minimum voltage and the maximum voltage supplied to the pressure generation source as a driving signal.

Typically, liquid ejecting apparatuses of the related art perform a flushing process before starting a printing job, during the printing job, and/or after the completion of the print job by discharging liquid k that has become thickened from inside the nozzles. Thus, the flushing process is performed to each nozzle provided on the recording head clean and unclogged. By this means, it is possible to consistently discharge the desired amount of ink drops from each nozzle, effectively preventing any missing dots. One example of one such flushing process of the related art is described in Japanese Patent Application JP-A-2006-123499.

In the typical flushing processes of the related art, the number of times that ink is discharged during the flushing process is determined based on "worst case" ink viscosity conditions. For example, in many processes it is assumed that three or four months have elapsed since the last ink was discharged from the nozzles. In other words, the flushing operation flushes the nozzles enough times to prevent any nozzle from clogging, even those nozzles where the ink is in the worst condition. For example, all of nozzles are set to discharge ink drops approximately 5,000 times during the flushing process. In these configurations, however, a large amount of ink drops are unnecessarily discharged because the ink has not thickened yet, resulting in a considerable amount of waste. On the other hand, if the ink has thickened beyond the predetermined "worst case" scenario, it is practically impossible, or at least very difficult to effectively clean the clogged nozzles using the predetermined number of the flushing operations, posing another problem that has not yet been addressed by the related art.

In particular, pigmented ink, which has excellent color reproduction qualities, tends to thicken easily because it is manufactured by dispersing pigment in an ink solvent with a high volatility. Thus, the pigment ink is prone to clogging the nozzles. Accordingly, it is necessary to perform flushing operations more frequently for the pigmented ink. In response to the increased number of flushing operations, however, there is a demand for reducing the amount of wastefully discharged ink during the flushing operations because the pigmented ink is expensive.

BRIEF SUMMARY OF THE INVENTION

One advantage of some aspects of the invention is a method for flushing a liquid ejecting apparatus that makes it possible to minimize the amount of liquid that is ejected from a liquid ejecting head thereof during flushing process. The invention further provides, advantageously, a liquid ejecting apparatus that adopts such a novel and inventive flushing method.

One aspect of the invention is a method for flushing for preventing the nozzles of a liquid ejecting apparatus from clogging by ejecting liquid from a nozzle of a liquid ejecting head toward a liquid catcher that is provided opposite to a nozzle opening surface of the liquid ejecting head without contacting the liquid ejecting head. The method comprises applying an electric field between the nozzle opening surface and the liquid catcher, ejecting the liquid from the nozzle toward the liquid catcher, detecting a change in the voltage that is attributable to electrostatic induction generated when the liquid is ejected toward the liquid catcher, and judging whether to continue or discontinue the ejection of the liquid based on the detected change in voltage.

A second aspect is a liquid ejecting apparatus that performs flushing by ejecting liquid from a nozzle of a liquid ejecting head toward a liquid catcher that is provided opposite to a nozzle opening surface of the liquid ejecting head without contacting the liquid ejecting head. The liquid ejecting apparatus comprises a liquid detecting section that is capable of applying an electric field between the nozzle opening surface and the liquid catcher and detecting a change in voltage that is attributable to electrostatic induction generated when the liquid is ejected from the nozzle toward the liquid catcher, and a flushing section that is capable of ejecting the liquid from the liquid ejecting head toward the liquid catcher and determining whether to continue ejecting liquid from the liquid ejecting head based on the detected change in voltage made by the liquid detecting section.

In each aspect of the invention, the determination whether to continue ejecting liquid is based on the state of the liquid that is ejected from the nozzle(s) during flushing operations. Therefore, no more liquid is ejected than necessary. Compared to flushing processes of the current state of the art, wherein a considerable amount of liquid is ejected using the assumption that the liquid retained in the nozzle is in the worst possible condition, aspects of the invention make it possible to minimize the amount of the liquid that is wastefully discharged during the flushing process, while ensuring that the nozzles remain unclogged.

BRIEF DESCRIPTION OF THE DRAWINGS

The invention will be described with reference to the accompanying drawings, wherein like numbers reference like elements.

FIGS. 8A and 8B are a set of diagrams that schematically illustrate the generation of an induced voltage, which is attributable to electrostatic induction, wherein FIG. 8A shows a voltage state immediately after the discharging of an ink drop, and FIG. 8B shows the voltage at the time the ink drop lands onto a test region of a cap member;

DESCRIPTION OF EXEMPLARY EMBODIMENTS

With reference to the accompanying drawings, a method for flushing a liquid ejecting apparatus according to an exemplary embodiment of the invention is described below. In addition, a liquid ejecting apparatus that is capable of performing unique flushing operation of the invention is also explained below. In the following description of the present embodiment of the invention, an ink-jet printer (hereafter referred to as "printer 1") is taken as a non-limiting example of a liquid ejecting apparatus that may be used in association with the present invention according to one embodiment of the invention.

Figure 1:
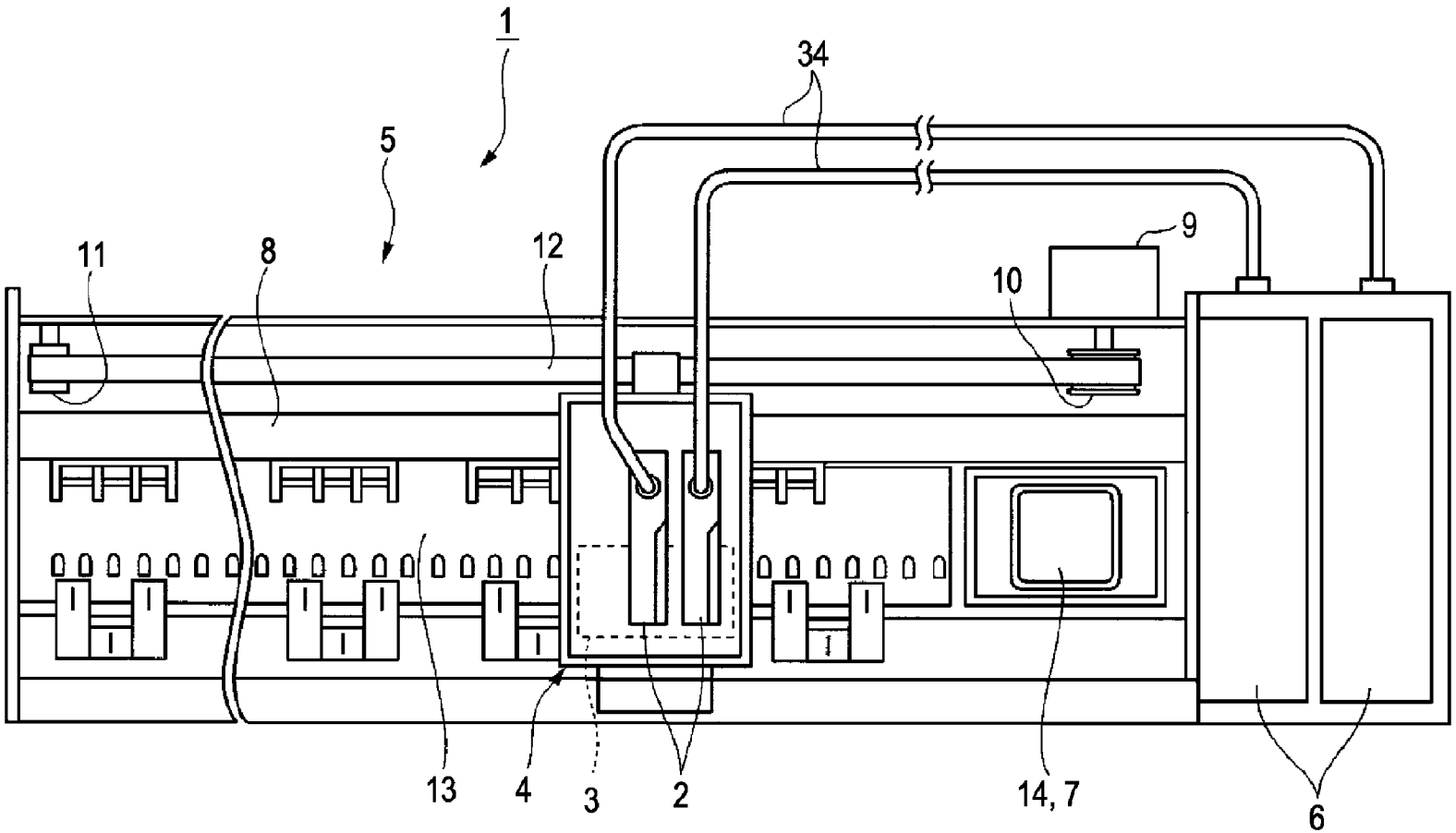
FIG. 1 is an exploded view illustrating an example of the partial configuration of a printer according to an exemplary embodiment of the invention.

FIG. 1 is an exploded partial view a printer 1 according to an exemplary embodiment of the invention. As main components thereof, without any intention to limit thereto, the printer 1 is made up of a carriage 4 and a printer main assembly 5. Sub tanks 2 and a recording head 3 are mounted on the carriage 4. The printer main assembly 5 includes but is not limited to a carriage-moving mechanism 65 (shown in FIG. 5), a paper-feeding mechanism 66 (shown in FIG. 5), a capping mechanism 14, and ink cartridges 6. The carriage-moving mechanism 65 moves the carriage 4. The paper-feeding mechanism 66 is capable of transporting a sheet of recording paper (not shown) or other liquid ejection target object. The capping mechanism 14 is used for cleaning operations. Specifically, the capping mechanism 14 is used to vacuum thickened ink L from each of nozzles provided on the recording head 3. The ink cartridges 6 constitute a reservoir that retains the ink L that is to be supplied to the recording head 3.

Figure 4:
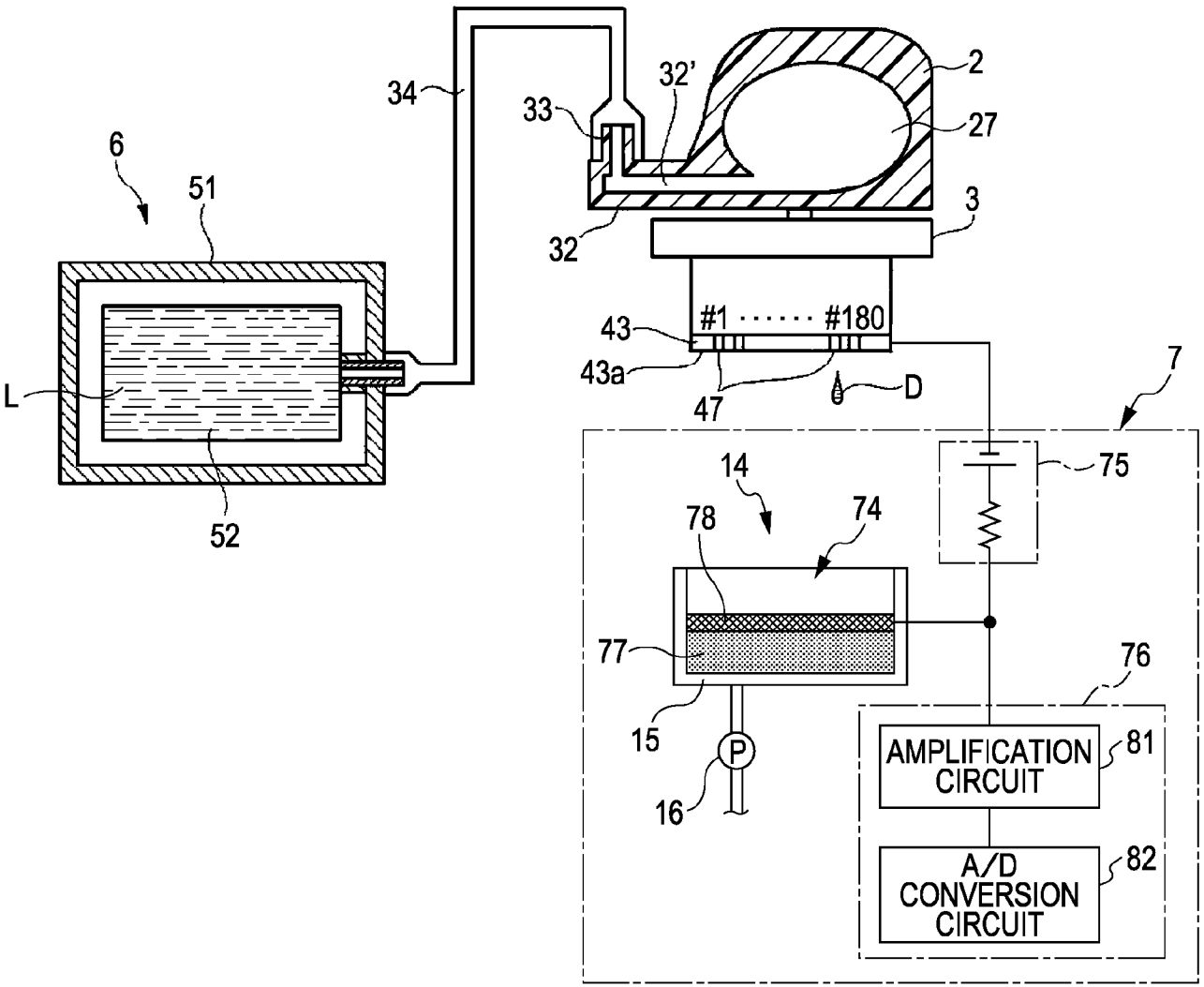
FIG. 4 is a schematic diagram illustrating an example of the configuration of the recording head, ink cartridge, and ink drop sensor according to an exemplary embodiment of the invention.
Figure 5:
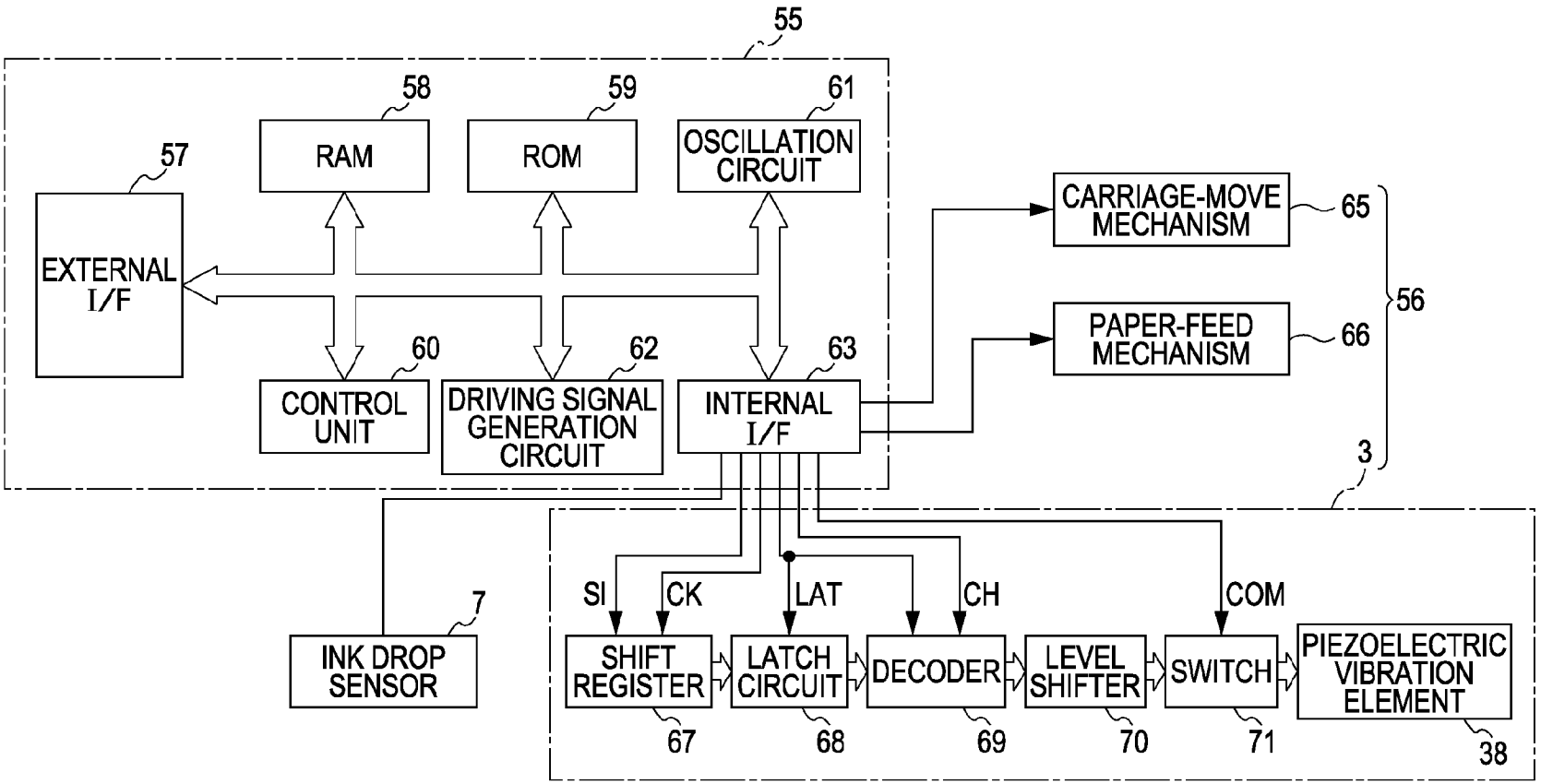
FIG. 5 is a block diagram illustrating an example of the electric configuration of the printer according to an exemplary embodiment of the invention

As shown in FIGS. 4 and 5, the printer 1 is further provided with an ink drop sensor 7, that is capable of detecting ink drops D that are discharged from the recording head 3. The ink drop sensor 7 is configured to electrify the ink drops D that are discharged from the recording head 3 and then detect a voltage change that is attributable to electrostatic induction that is generated at the time when the electrified ink drops D "fly," or drop through the air. The ink drop sensor 7 outputs the detected change in voltage as a detection signal, using a process described more fully below.

The carriage-moving mechanism 65 is made up of, though not necessarily limited to, a guide axis 8, a pulse motor 9, a driving pulley 10, an idle pulley 11, and a timing belt 12. The guide axis 8 is built in the printer main assembly 5 so as to extend in the width direction thereof. The driving pulley 10 is connected to the rotation axis of the pulse motor 9. With such a configuration, the driving pulley 10 rotates under a driving force that is applied by the pulse motor 9. The idle pulley 11 is provided at a position opposite to the driving pulley 10 along the width direction of the printer main assembly 5. The timing belt 12 is stretched between the driving pulley 10 and the idle pulley 11. The carriage 4 is fixed to the timing belt 12. As the pulse motor 9 is driven, the carriage 4 reciprocates along the guide axis 8 in the main scanning direction.

The paper-feeding mechanism 66 is made up of, though not necessarily limited to, a paper-feeding motor and a paper-feeding roller. The paper-feeding roller rotates under a driving force that is applied by the paper-feeding motor. Both of the paper-feeding motor and the paper-feeding roller are not shown in the drawing. The paper-feeding mechanism 66 feeds a plurality of sheets of recording paper in a sequential manner onto a platen 13 in synchronization with recording or printing operations.

The capping mechanism 14 is made up of, though not necessarily limited to, a cap member 15 and a suction pump 16. The cap member 15 is made of an elastic material, such as a rubber, or the like. The cap member 15 is molded in a tray-like shape and is provided at a home position. The home position is set at an edge in a region that is outside a recording region but inside the traveling range of the carriage 4. The carriage 4 stays at the home position when power is turned OFF. In addition, the carriage 4 stays at the home position when a recording or liquid ejection process is not performed for a long time period.

Figure 3:
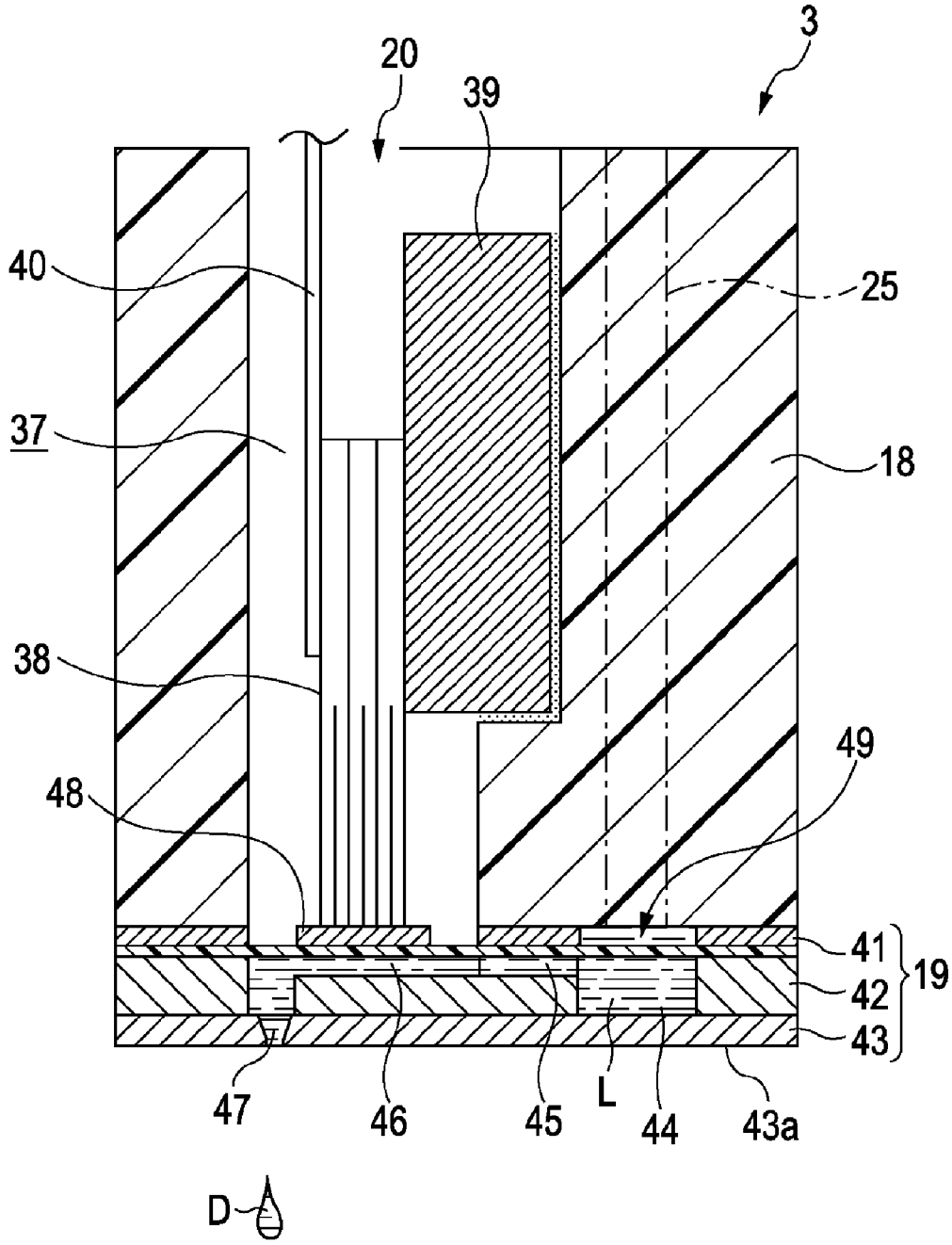
FIG. 3 is a sectional view illustrating an exemplary configuration of an essential part of the recording head according to an exemplary embodiment of the invention.

When the carriage 4 is located at the home position, the cap member 15 is in contact with the surface of a nozzle substrate 43, as shown in FIG. 3. That is, the cap member 15 is in contact with the nozzle opening surface 43*a* of the recording head 3 in order to seal the nozzles 47. When the suction pump 16 is operated when the nozzles are sealed, the pressure inside the cap member 15 is reduced, causing the ink L retained in the recording head 3 to be ejected from the nozzles 47.

During the flushing process when the ink drops D are discharged in order to remove the thickened ink L and air bubbles, the cap member 15 typically catches the discharged ink drops D. Generally, the flushing operations are performed before the recording head 3 performs a recording process and/or during the recording process, although the flushing operation is not limited to these configurations and may be performed at any time.

Figure 2:
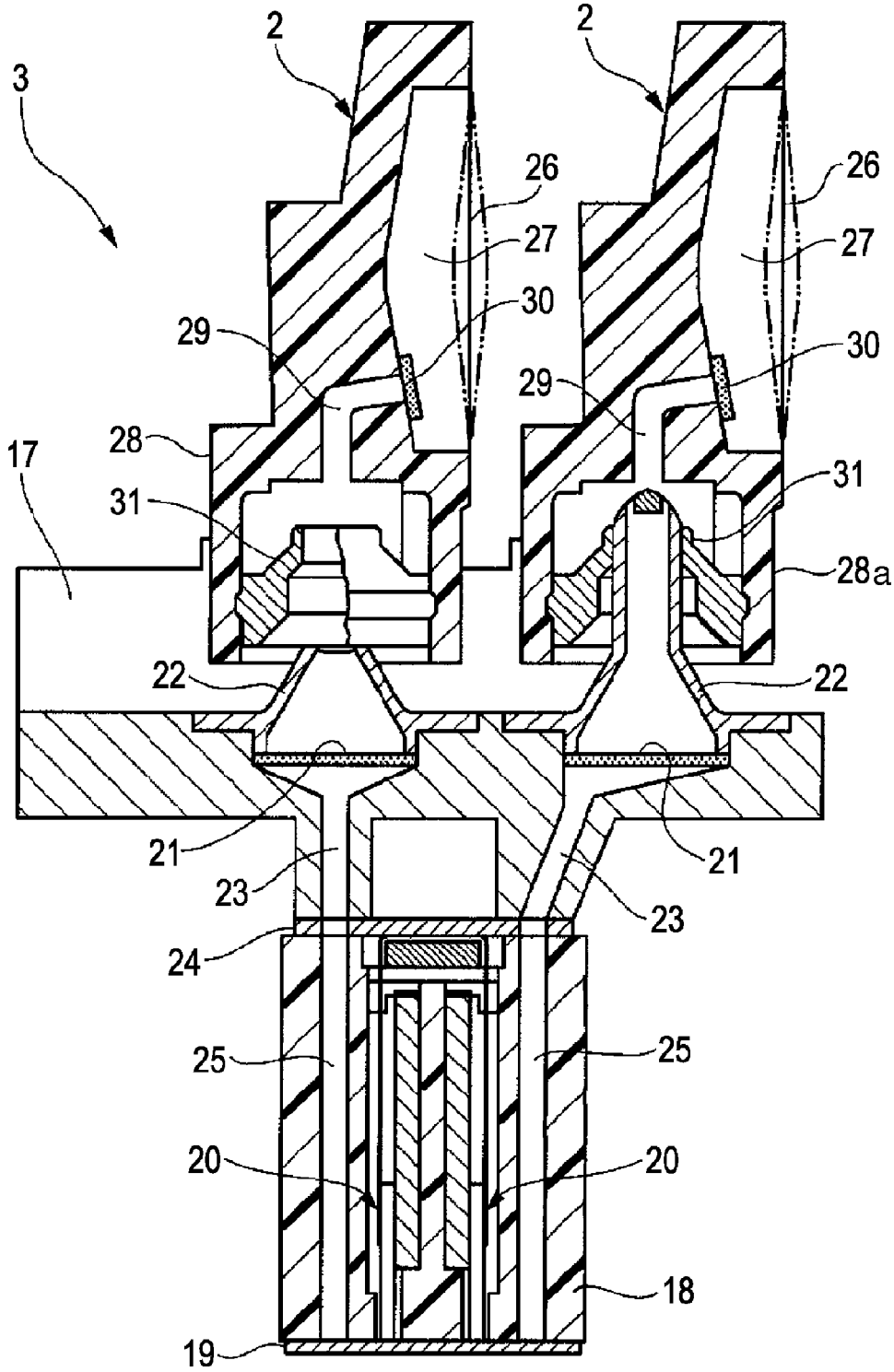
FIG. 2 is a sectional view illustrating an example of the configuration of a recording head according to an exemplary embodiment of the invention.

FIG. 2 is a sectional view that illustrates an example of the configuration of the recording head 3. FIG. 3 is a sectional view that illustrates an exemplary configuration of a portion of the recording head 3. FIG. 4 is a diagram that schematically illustrates an example of the configuration of the recording head 3, the ink cartridge 6, and the ink drop sensor 7. Although it is not limited, the recording head 3 is typically made up of an induction or inlet needle unit 17, a head case 18, a fluid or flow channel unit 19, and an actuator unit 20. A pair of ink inlet needles 22 are provided on the upper surface of the inlet needle unit 17 on either side of a filter 21. These two ink inlet needles 22 are attached adjacent to each other. The aforementioned sub tank 2 is attached to each of the ink inlet needles 22. A pair of ink-guiding induction channels 23 are formed inside the inlet needle unit 17, and correspond to the pair of ink inlet needles 22. The upper end of each of the ink-guiding induction channels 23 communicates with the corresponding ink inlet needle 22 with a filter 21 being interposed between them. On the other hand, the lower end of each of the ink-guiding induction channels 23 communicates with a corresponding head case flow channel 25, which are formed inside the head case 18, with a grommet 24 being disposed in-between. In the configuration of the printer 1 according to the present embodiment of the invention, two sub tanks 2 are provided because the printer 1 uses two types of ink. However, the invention is not limited to such a configuration. That is, the invention is also applicable to a modified configuration in which three or more types of ink are used.

Each of the sub tanks 2 is made of a resin material such as polypropylene or the like. The sub tank 2 has a cavity or concave portion that constitutes an ink-retaining chamber 27. A transparent elastic sheet member 26 is provided over the opening of the concave portion of the sub tank 2 in order to partition the ink-retaining chamber 27. A needle connection portion 28*a* which protrudes downward toward the ink inlet needle 22 is provided at the bottom of each of the sub tanks 28. The ink inlet needle 22 is inserted into the needle connection portion 28*a*. The ink-retaining chamber 27 that is formed in each of the sub tanks 2 has a shallow mortar shape. The upper opened end of the connection flow channel 29, is formed at a position that is slightly below the center of the vertical side of the ink-retaining chamber 27 and is capable of providing communication between the ink-retaining chamber 27 and the needle connection portion 28. A tank filter 30 is provided at the opening of each of the connection flow channels 29 so as to filter the ink L. A sealing member 31 is provided in the needle connection portion 28. Each of the ink inlet needles 22 is inserted into the sealing member 31 in order to form a liquid-tight seal. As illustrated in FIG. 4, the sub tank 2 has an extending portion 32, which includes a communication groove portion 32' that is in communication with the ink-retaining chamber 27. An ink flow-in port 33 protrudes from the upper surface of the extending portion 32.

An ink supply tube 34 supplies ink L retained in the ink cartridge 6 to the ink flow-in port 33. Using this configuration, the ink L that has flowed through the ink supply tube 34 enters the ink flow-in port 33. Then, the ink L passes through the communication groove portion 32' and then flows into the ink-retaining chamber 27. The elastic sheet member 26 previously mentioned can be deflected in one direction when the ink-retaining chamber 27 contracts and another direction in which the ink-retaining chamber 27 expands. By expanding and contracting with the ink-retaining chamber 27, the elastic sheet member 26 serves a dampening function, and the pressure changes in the ink L are effectively absorbed. Therefore, the ink L is supplied to the recording head 3 after the pressure variation in the sub tank 2 is absorbed.

The head case 18 is a hollow box-like member that is made of a synthetic resin. The flow channel unit 19 is adhered to the bottom surface of the head case 18. The head case 18 houses the actuator unit 20 inside a housing cavity 37 formed in the head case 18. The inlet needle unit 17 is attached to the top surface of the head case 18 opposite to the previously mentioned flow-channel-unit 19 side, with a grommet 24 being interposed in-between the inlet needle unit 17 and flow-channel-unit 19. The head case flow channels 25 are formed in the head case 18 in such that each of them penetrates through the head case 18 along the vertical direction. The upper open end of each of the head case flow channels 25 communicates with a corresponding ink-guiding induction channel 23 of the inlet needle unit 17 on the other side of a grommet 24. On the other hand, the lower open end of each head case flow channel 25 communicates with a common ink-retaining chamber 44 that is formed in the flow channel unit 19. In this configuration, the ink L that has been taken in by the ink inlet needle 22 goes through the ink-guiding induction channel 23 to the head case flow channel 25, where the ink L is supplied into the common ink-retaining chamber 44.

In this embodiment, the actuator unit 20, which is housed inside the housing cavity 37 of the head case 18, is comprised of a plurality of piezoelectric vibration elements 38 that are arrayed like comb teeth to a fixation plate 39. The actuator unit 20 is also comprised of a flexible cable 40 that functions as a wiring member for supplying a driving signal from the printer main assembly 5 to the piezoelectric vibration elements 38. The fixed end of each piezoelectric vibration element 38 is connected to the fixation plate 39, whereas the remaining free ends protrude outward from the fixation plate 39. In other words, each of the piezoelectric vibration elements 38 is mounted to the fixation plate 39 in the form of a cantilever. In one embodiment, the fixation plate 39 that supports each of the piezoelectric vibration elements 38 is made of a stainless steel that has the thickness of approximately 1 mm. The actuator unit 20 is firmly supported in the housing cavity 37 by bonding the rear surface of the fixation plate 39 to the inner wall surface of the head case 18 that demarcates the housing cavity 37.

The flow channel unit 19 is comprised of a vibration plate 41, a flow channel substrate 42, and the previously mentioned nozzle substrate 43. Specifically, these flow channel unit component members are laminated onto one on another and bonded together using a means of an adhesive so as to constitute a single flow channel unit. The flow channel unit 19 provides a continuous ink flow channel that extends from the common ink-retaining chamber 44 to the ink supply port 45, through the pressure generation chamber 46, where it finally reaches the nozzle 47. The pressure generation chamber 46 is configured as an elongated compartment that extends in a direction that is orthogonal to a direction along which the nozzles 47 are aligned. The common ink-retaining chamber 44 is configured to communicate with the head case flow channel 25. In addition, the common ink-retaining chamber 44 is configured as a compartment which receives ink L flowing from the ink-inlet-needle side 22. Once it reaches the common ink-retaining chamber 44, the ink L goes through the ink supply port 45 where it is flows into each individual pressure generation chamber 46.

The nozzle substrate 43 is a thin plate that is made of a meta provided at the bottom of the flow channel unit 19. The plurality of nozzles 47 are arrayed into a plurality of lines having a pitch between adjacent nozzles 47 that corresponds to a predetermined dot formation density. In one example, the pitch is set at 180 dpi. In a preferred embodiment of the invention, the nozzle substrate 43 is made of a stainless steel plate. In the exemplary configuration, the recording head 3 has 22 lines of the nozzles 47 provided adjacent to one another which correspond to the previously mentioned two sub tanks 2. Furthermore, in this example, each nozzle line comprises one hundred eighty nozzles 47. The flow channel substrate 42 that is interposed between the nozzle substrate 43 and the vibration plate 41 is a plate member having a flow channel portion where the ink L may flow. Specifically, the flow channel portion thereof is demarcated as a continuous stretch of cavities that includes, but is not necessarily limited to, the common ink-retaining chamber 44, the ink supply port 45, and the pressure generation chamber 46.

In the present embodiment of the invention, the flow channel substrate 42 is formed using an anisotropic etching technique. More specifically, the anisotropic etching technique is applied to a silicon wafer, which is a base substance that has crystallinity.

The vibration plate 41 is configured as a complex plate member having a dual-plate structure, typically comprising a supporting plate that is made of a metal such as a stainless steel or the like with an elastic film laminated thereon. An island portion 48 is formed at a portion of the vibration plate 41 that is opposite to the pressure generation chamber 46 by etching or removing a part of the supporting plate so as to form a ring-shaped region. The front surface of the piezoelectric vibration element 38 is connected to the island portion 48, such that the island portion 48 functions as a diaphragm. That is, the vibration plate 41 is formed so that the elastic film around the island portion 48 deforms elastically as the piezoelectric vibration element 38 operates. In addition, the vibration plate 41 further functions as a compliance portion 49 that seals one open surface of the flow channel substrate 42. A portion of the compliance portion 49 is formed from elastic film by etching or removing a part of the supporting plate, similar to the method used to form the diaphragm portion described.

In this configuration, when a driving signal is supplied to the piezoelectric vibration element 38 via the flexible cable 40, the piezoelectric vibration element 38 becomes deflected so as to expand and contract in the vertical direction. As the piezoelectric vibration element 38 expands and contracts, the island portion 48 moves, causing it to move closer and further from the pressure generation chamber 46. As the island portion 48 moves, the capacity of the pressure generation chamber 46 fluctuates, causing a pressure change in the ink L retained in the pressure generation chamber 46. Because of the pressure change, the nozzle 47 discharge the ink drops D.

As illustrated in FIG. 4, each of the ink cartridges 6 is comprised of a case member 51 that is formed in a hollow box shape and an ink pack 52 that is made of a material having plasticity. The ink pack 52 is housed in a housing compartment formed inside the case member 51. The ink cartridge 6 communicates with one end of the ink supply tube 34. The ink cartridge 6 supplies the ink L retained in the ink pack 52 to the recording head 3 by utilizing the pressure difference between the nozzle opening surface 43*a* of the recording head 3 and the ink cartridge 6 due to gravity. Specifically, the ink cartridge 6 is positioned higher than the recording head 3, so that a small negative pressure is applied to the meniscus of the nozzle 47. Using this configuration, the supply of the ink L to the pressure generation chamber 46 and the subsequent discharging of the ink L from the pressure generation chamber 46 are performed using a pressure change that is caused by the operation of the piezoelectric vibration element 38.

As illustrated in FIG. 4, the ink drop sensor 7 is comprised of the aforementioned cap member 15, a test region 74, a voltage application circuit 75, and a voltage detection circuit 76. When the recording head 3 is placed at the home position, the cap member 15 functions as a liquid drop catcher. The test region 74 is formed inside the cap member 15. The voltage application circuit 75 applies a voltage between the test region 74 and the nozzle substrate 43 of the recording head 3. The voltage detection circuit 76 detects the voltage of the test region 74.

The cap member 15 is a tray-shaped member having an open top. The cap member 15 is made of an elastic member such as an elastomer or the like. An ink absorber 77 is provided inside the cap member 15. The ink absorber 77 is made of, for example, a non-woven fabric such as felt with high ink retention properties. A mesh electrode member 78 is provided on the upper surface of the ink absorber 77, wherein a surface of the electrode member 78 corresponds to the test region 74. The electrode member 78 is formed as a lattice-shaped mesh of metal such as a stainless steel or the like. As ink drops D land on the surface of the electrode member 78, they are absorbed through spaces of the lattice-shaped electrode member 78 to reach the ink absorber 77 that is provided beneath the electrode member 78. The ink drops D are then absorbed and retained by the ink absorber 77.

The voltage application circuit 75 provides an electric connection between the electrode member 78 and the nozzle substrate 43 of the recording head 3 using a direct-current (DC) power supply (e.g., 400V) with a resistance element (e.g., 1 MΩ) being interposed in-between the electrode member 78 and nozzle substrate 43. Using this configuration, the electrode member 78 serves as a positive pole, whereas the nozzle substrate 43 of the recording head 3 serves as a negative pole. The voltage detection circuit 76 has an amplification circuit 81, which amplifies a voltage signal coming from the electrode member 78 and outputs the amplified signal, and an A/D conversion circuit 82 which is capable of converting on the amplified signal from the amplification circuit 81 and sending a converted signal to a printer controller 55. The amplification circuit 81 amplifies a voltage signal supplied from the electrode member 78 at a predetermined amplification factor before outputting the amplified signal. The A/D conversion circuit 82 converts an analog signal that is outputted from the amplification circuit 81 into digital signal and outputs the A/D-converted signal that acts as a detection signal to the printer controller 55.

Figure 6:
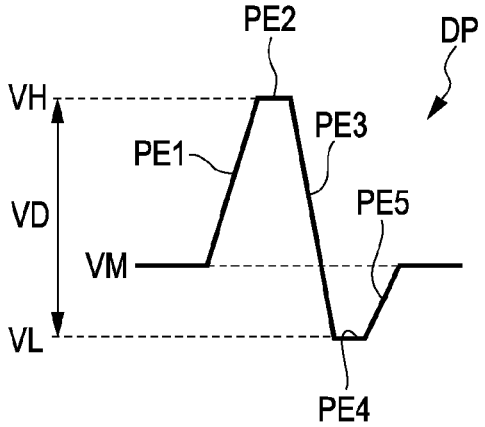
FIG. 6 is a diagram illustrating an example of a discharge pulse pattern according to an exemplary embodiment of the invention.

FIG. 5 is a block diagram that schematically illustrates an example of the electric configuration of the printer 1. FIG. 6 is a diagram that illustrates an exemplary discharge pulse pattern. In the present embodiment, the printer 1 comprises the printer controller 55, a printer engine 56, and the ink drop sensor 7. The printer controller 55 includes but not limited to an external interface, abbreviated "external I/F" 57, a RAM 58, a ROM 59, a control unit 60, an oscillation circuit 61, a driving signal generation circuit 62, and an internal interface, abbreviated as "internal I/F" 63. Print data and other data are inputted into the external I/F 57 from an external device such as a host computer or the like. The RAM 58 stores various kinds of data and the like. The ROM 59 stores control programs used for executing various kinds of controls and the like. The oscillation circuit 61 generates a clock signal. The driving signal generation circuit 62 generates a driving signal that is supplied to the recording head 3. The internal I/F 63 outputs discharge data, which is obtained by expanding the print data on a dot-by-dot basis. The internal I/F 63 further outputs a driving signal or the like to the recording head 3.

The print engine 56 is comprised of the recording head 3, the aforementioned carriage-moving mechanism 65, and the aforementioned paper-feeding mechanism 66. The recording head 3 is comprised of a shift register 67, a latch circuit 68, a decoder 69, a level shifter 70, a switch circuit 71, and the piezoelectric vibration elements 38. Discharge data is set at the shift register 67. The latch circuit 68 latches the discharge data set at the shift register 67. The decoder 69 translates the discharge data supplied from the latch circuit 68 in order to generate pulse selection data. The level shifter 70 functions as a voltage amplifier. The switch circuit 71 controls the supply of the driving signal to the piezoelectric vibration elements 38. The control unit 60 expands the print data that transmitted from the external device into discharge data which corresponds to a dot pattern and then transmits the expanded data to the recording head 3. Then, based on the received discharge data, the recording head 3 discharges the ink drops D.

The control unit 60 further functions as a flushing processing unit that executes flushing operations based on flushing conditions stored in the ROM 59. The flushing is a discharging or cleaning operation in which the thickened ink L and air bubbles are forcibly ejected from of each of the nozzles 47 on the recording head 3 so as to prevent the nozzles 47 from becoming clogged. In the flushing operations, each of the nozzles 47 discharges the ink drops D toward the cap member 15 a predetermined number of times. One example of a flushing process is called "pre-print flushing," which is a flushing process that is performed after the power of the printer 1 has been turned ON but before the recording head 3 starts recording operations. In the pre-print flushing, all of the nozzles 47 are configured to discharge the ink drops D, a predetermined number of times, which typically ranges from 3,000 to 5,000 times, although the setting is not limited. These flushing conditions are stored in the ROM 59. The number of times of discharging operations executed in the pre-print flushing is determined using the assumption that the printer 1 has not been powered ON for several months. That is, the discharging operations are set to be large enough to sufficiently unclog all the nozzles 47 after a long period of disuse, by having all of the nozzles 47 discharge a large number of times. It should be noted that the number of times that the discharging operations are performed is a default value that is initially set immediately after the power of the printer 1 has been turned ON. Accordingly, in actual implementation of the flushing process, the number of times that the discharging operation is performed may be changed to an optimum value.

In addition to the pre-print flushing process described above, another flushing process called "periodical flushing" may be performed during a recording operation of the recording head 3. Furthermore, another flushing process, called "paper-feed flushing" is executed at the time when recording paper is fed to the recording head 3 while "paper-eject flushing" is performed immediately after the recording paper is ejected. During each of these flushing process, the number of times of that the discharging operation is performed is set at an arbitrary range, from between a few dozen times to several hundred times.

Voltage data and a timing signal are inputted into the driving signal generation circuit 62. The voltage data indicates the amount of change in the voltage in a discharge pulse that is supplied to the piezoelectric vibration element 38. The timing signal specifies each point in time when the voltage value of the discharge pulse changes. Based on this voltage data and timing signal, the driving signal generation circuit 62 generates a driving signal that includes a discharge pulse DP having a waveform, such as the waveform illustrated in FIG. 6. The waveform of the discharge pulse DP is made up of a first charge element PE1, a first hold element PE2, a discharge element PE3, a second hold element PE4, and a second charge element PE5. During the first charge element PE1, the electric potential or voltage is raised from a reference electric potential level VM to a maximum electric potential level VH at a relatively gentle inclination. During the first hold element PE2, the electric potential is maintained at the maximum electric potential level VH. During the discharge element PE3, the electric potential is lowered from the maximum electric potential level VH to a minimum electric potential level VL at a steep downward inclination. During the second hold element PE4, the electric potential is maintained at the minimum electric potential level VL for a short period of time. Finally, during the second charge element PE5, the electric potential is raised from the minimum electric potential level VL to the original reference electric potential level VM. The driving voltage VD of the discharge pulse DP, or difference between the maximum electric potential level VH and minimum electric potential level VL, is set at a value at which the predetermined amount of liquid is discharged from the nozzle 47 as an ink drop D. As may be understood by one of ordinary skill in the art, the waveform of the discharge pulse DP is not limited to the specific example illustrated in FIG. 6. Various kinds of other alternative waveforms may be adopted for the discharge pulse D.

Upon the application of the discharge pulse DP described above, an ink drop D is discharged as follows. As the first charge element PE1 is applied to the piezoelectric vibration element 38, the piezoelectric vibration element 38 contracts, causing the pressure generation chamber 46 to expand. The expanded state of the pressure generation chamber 46 is maintained for a very short time period (PE2) until the piezoelectric vibration element 38 expands with a steep inclination as the discharge element PE3 is applied. Then the piezoelectric vibration element 38 expands quickly, causing the capacity of the pressure generation chamber 46 to contract to a size that is smaller than the reference capacity, which is the capacity of the pressure generation chamber 46 obtained when the reference electric potential VM is applied to the piezoelectric vibration element 38. As a result, a meniscus of ink L in the nozzle 47 becomes highly pressurized, causing a predetermined amount of the ink drop D to be discharged from the nozzle 47. Thereafter, the second hold element 4 is applied to the piezoelectric vibration element 38, followed by the application of the second charge element PE 5. As these pulse segments are applied to the piezoelectric vibration element 38, the capacity of the pressure generation chamber 46 returns to the original reference capacity so as to terminate vibration of the meniscus of ink L that occurs when the ink drop D is discharged.

One aspect of the invention is a printer 1 having the configuration described above that is capable of minimizing the amount of the ink L discharged during the flushing operation, by determining whether to continue or discontinue the flushing operation based on the detection signal outputted from the ink drop sensor 7. In other words, the printer 1 minimizes the amount of the ink L discharged during the flushing operation by changing the flushing conditions based on the detection signal outputted from the ink drop sensor 7. In the following description, an explanation is given of the pre-print flushing operation performed by the printer 1.

Figure 7:
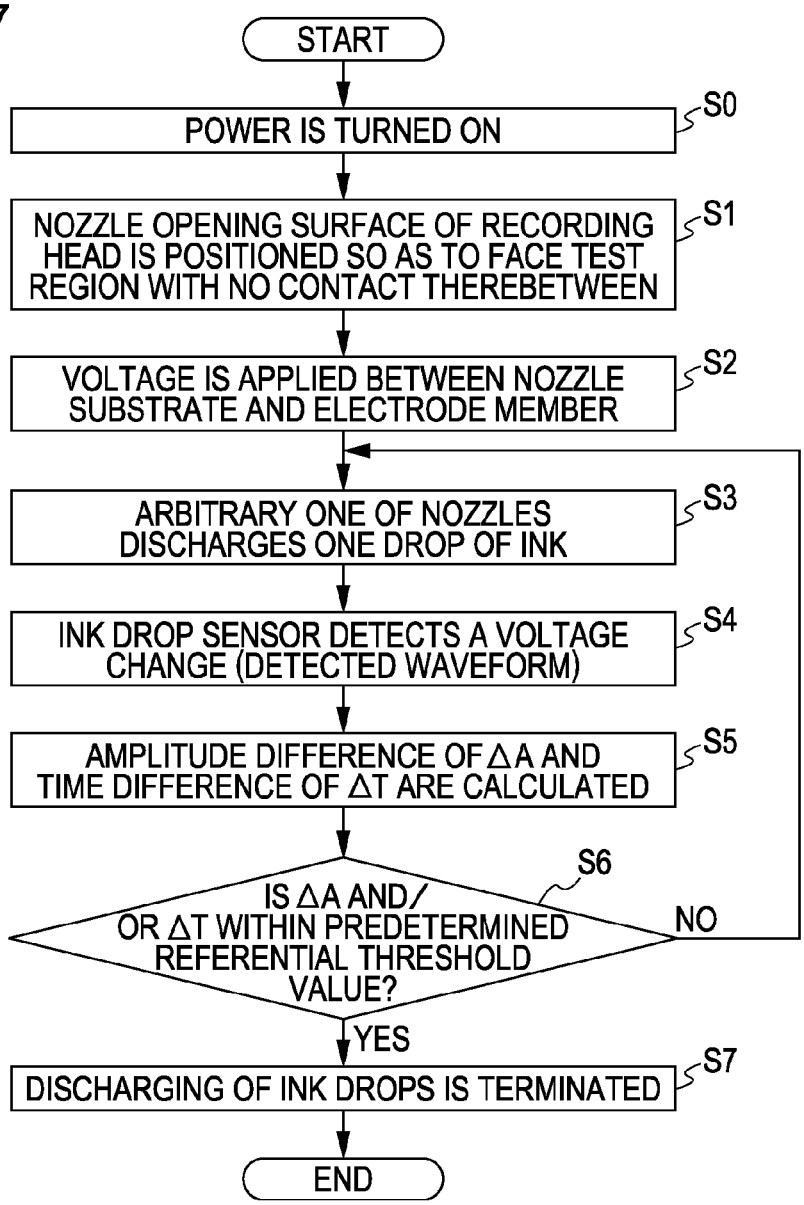
FIG. 7 is a flowchart illustrating an example of a series of flushing processes using the ink drop sensor according to an exemplary embodiment of the invention.
Figure 8A:
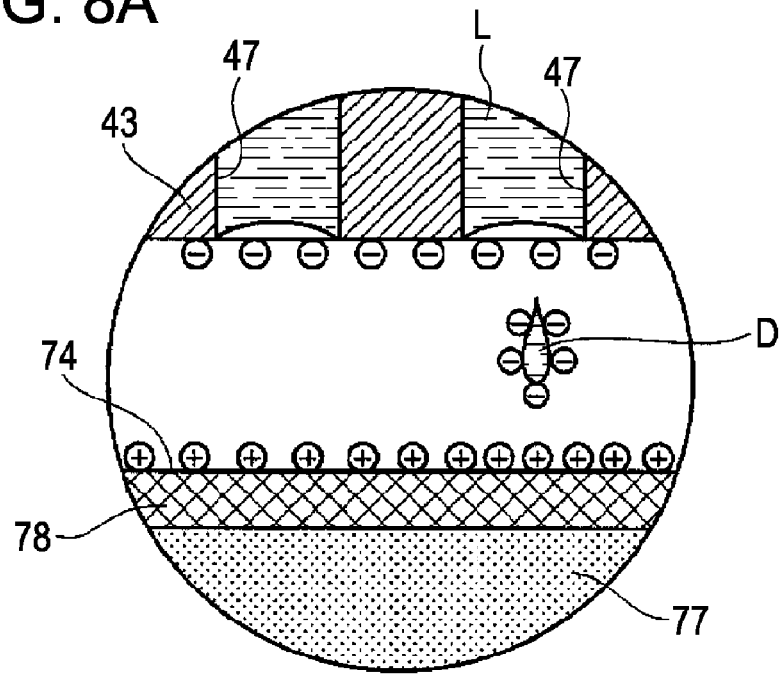
Figure 8B:
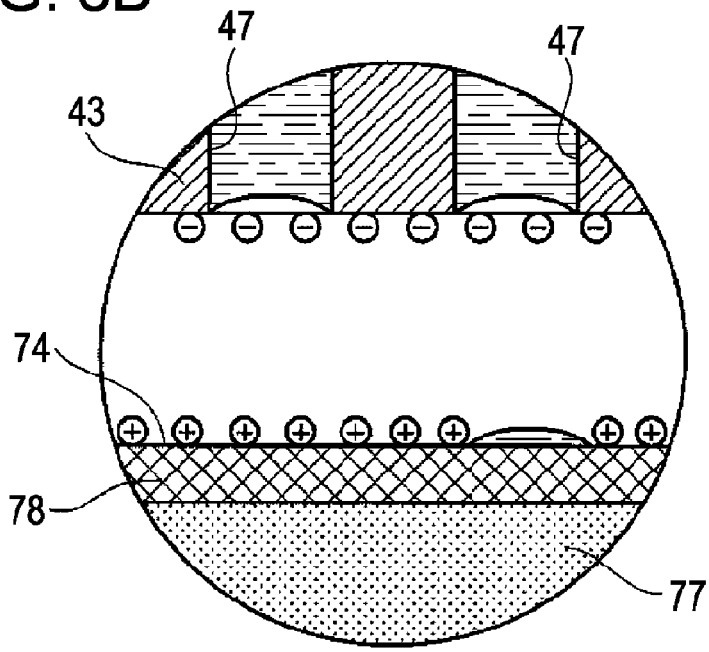
Figure 9:
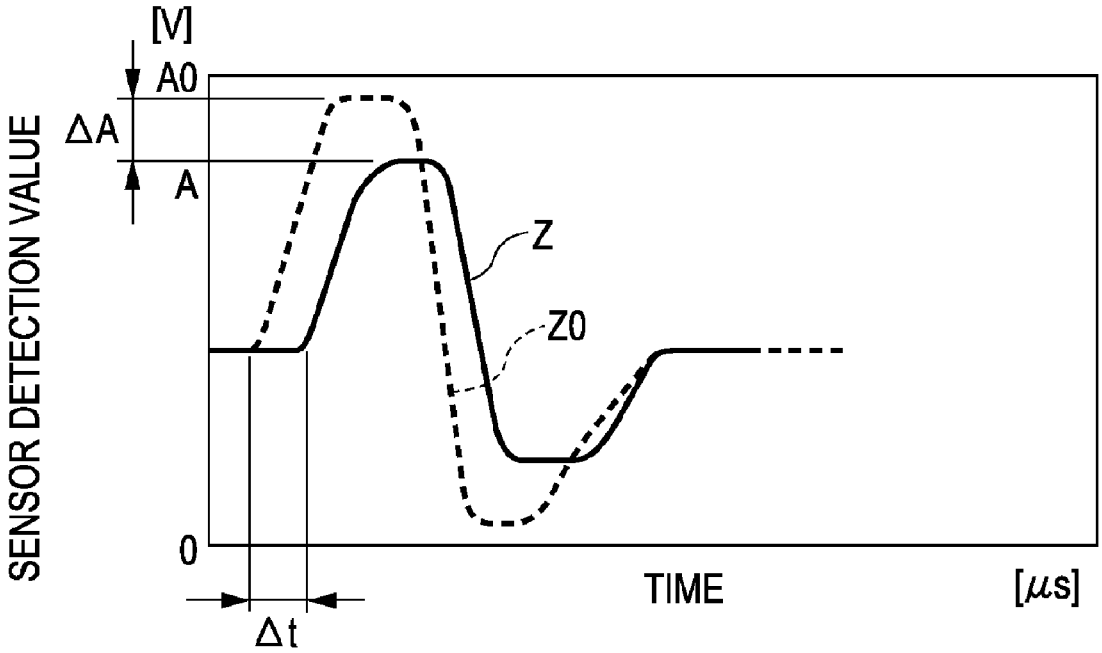
FIG. 9 is a diagram that shows an example of the waveform of a detection signal that may be outputted from the ink drop sensor of the invention.
Figure 10:
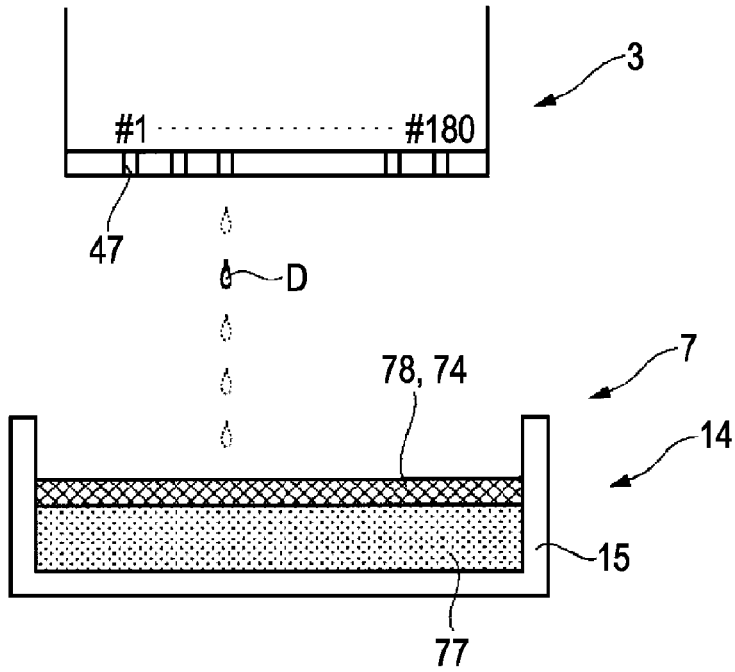
FIG. 10 is a schematic diagram that illustrates an example of the order of discharging the ink drops according to an exemplary embodiment of the invention.

FIG. 7 is a flowchart that illustrates an example of a series of flushing processes using the ink drop sensor 7. FIGS. 8A and 8B are set of diagrams that schematically illustrate the generation of an induced voltage which is attributable to electrostatic induction. Specifically, FIG. 8A shows a voltage state immediately after the printer 1 discharges of the ink drop D. FIG. 8B shows the voltage state when the ink drop D lands onto the test region 74 of the cap member 15. FIG. 9 is a diagram that shows an example of the detection signal waveform that may be outputted from the ink drop sensor 7. FIG. 10 is a diagram that schematically illustrates an example of the discharging order of the ink drops D.

Before the power of the printer 1 is turned ON, that is during the OFF period, the carriage 4 stays at the home position. During this time, the cap member 15 is in contact with the surface of the nozzle substrate 43 of the recording head 3 in order to seal the nozzle substrate 43, so as to prevent the ink L retained inside each of the nozzles 47 from drying due to exposure to air. Even if such sealing protection is provided, however, the ink L may gradually dry if the power of the printer 1 remains OFF for a long period of time. In order to clean any clogged nozzles caused by thickened ink L, the pre-printing flushing operation is always performed S0 when the printer 1 is powered ON.

During the pre-print flushing operation, the cap member 15 is lowered S1 by an elevation mechanism (not shown) so as to position the recording head 3 above the cap member 15. As a result, the nozzle opening surface 43*a* of the recording head 3 faces the test region 74 without making contact. Then, the voltage application circuit 75 applies S3 a voltage between the nozzle substrate 43 and the electrode member 78. When the voltage is applied between the nozzle substrate 43 and the electrode member 78, the piezoelectric vibration element 38 is driven by the discharge pulse DP so that an arbitrary nozzle 47 discharges S3 the ink drop D.

Then, since the nozzle substrate 43 is configured as the negative electrode, a portion of the negative electric charge accumulated on the nozzle substrate 43 travels with the ink drop D as illustrated in FIG. 8A. As a result thereof, the discharged ink drop D has a negative charge. As the ink drop D approaches the test region 74 of the cap member 15, positive electric charges increase at the test region 74 on the surface of the electrode member 78, due to electrostatic induction. Consequently, the level of the voltage applied between the nozzle substrate 43 and the electrode member 78 becomes higher than the reference level when no ink drop D has been discharged, due to the induced voltage generated by electrostatic induction. After the ink drop D has landed onto the electrode member 78, as illustrated in FIG. 8B, the positive electric charges of the electrode member 78 are neutralized by the negative electric charges of the ink drop D. For this reason, the level of the voltage applied between the nozzle substrate 43 and the electrode member 78 falls, to a level that is below the reference voltage level. Then, the level of the voltage between the nozzle substrate 43 and the electrode member 78 returns to the original voltage level. Therefore, the waveform of a detection signal that is outputted from the ink drop sensor 7 has a curve similar to the example illustrated in FIG. 9; that is, after an initial rising, the voltage falls to a lowest level below its original level, before it returns to the original level. As described above, the ink drop sensor 7 detects S4 detects a change in voltage that occurs when the ink drop D is discharged from each of the nozzles 47.

Herein, if the ink drop D is comprised of thickened ink L, the amount of ink discharged in the drop is relatively small compared to a normal ink drop D when the same discharge pulse DP is used. Therefore, as shown in a solid line in FIG. 9, the amplitude A of a detection signal or waveform Z that is outputted from the ink drop sensor 7 is smaller than the amplitude A0 of a normal detection signal or ideal waveform Z0 by an amplitude difference of ΔA. In addition, the point in time when the ink drop D is released from the nozzle substrate 43 after the application of the discharge pulse DP is also delayed when compared to normal release timing. Specifically, the point in time at which the voltage rises is later than the point when the voltage rises in a normal ink drop D by a time delay of ΔT. Therefore, based on the comparison S5 of the amplitude A of the detected waveform Z of a detection signal that is outputted from the ink drop sensor 7 and that of the ideal waveform Z0 and/or the voltage rising point timing of the detected waveform Z of the detection signal that is outputted from the ink drop sensor 7 and that of the ideal waveform Z0, ΔA and ΔT, respectively, it is possible to estimate the viscosity of the ink L in each of the nozzles 47 provided on the recording head 3.

As previously described, in a printer of the present art, the number of times that the ink drops D are discharged, or the specific the flushing conditions, performed during the pre-print flushing is based on the assumption that the ink L retained in each of the nozzles 47 has the worst possible thickness. However, in most cases, the actual viscosity of the ink L will not reach that thickness. Therefore, it is possible to minimize the amount of ink L that is wastefully discharged during flushing operations by detecting or estimating the viscosity level of the ink L and then changing the number of times that the discharge operations is performed based on the detected level of viscosity.

Specifically, during each flushing operation, a judgment S6 is made as to whether the detection signal outputted from the ink drop sensor 7 resulting from a discharged ink drop D from an arbitrary ink nozzle 47 is within a predetermined threshold value. If not, ink drops D are discharged S3 from the current nozzle 47 again, whereas if it is determined that the detection signal is within the threshold, the discharging of the ink drops D from the current nozzle 47 is terminated S7.

That is, as illustrated in FIG. 10, the discharging of the ink drops D is continually performed in an arbitrary nozzle 47. When viscosity of the ink drop D reaches the predetermined viscosity level, the flushing operation for the current nozzle 47 is terminated. Thus, the interval of discharging the ink drops D is set at a value that is large enough to obtain the desired waveform Z. In one example, the interval is set at between 2-5 μm. In another embodiment, if it is judged S6 that the discharging of the ink drops D from the current nozzle 47 should continue, the flushing conditions may be changed based on the detected viscosity state of the ink L as determined by the ink drop sensor 7. That is, if the determination in step S6 is NO, the number of times of discharging operations used during the subsequent discharges may be reduced based on the detected viscosity state of the ink L.

A judgment as to whether the detection signal has reached the predetermined state or not, that is, whether the detection signal has satisfied the predetermined referential threshold conditions or not, is made based on the amplitude A and or the timing T of the detected signal of waveform Z by the ink drop sensor 7, as explained more fully below. More specifically, the reference value or threshold for the amplitude A of the detected waveform Z is set at, for example, 80% of the amplitude A0 of the ideal waveform Z0. In other words, the difference in amplitude ΔA must be 20% or less of the amplitude A0 of the detected waveform Z ($\Delta A \leqq 0.2 \times A0$ [V]). Alternatively, the reference value or threshold of the timing difference of the detected waveform Z is set at, for example, 0.5 μs after that of the ideal waveform Z0 ($\Delta T \leqq 0.5$ [μs]). Using these settings, the conditions of the pre-print flushing process are changed so that the ink drops D continue to discharge until the amplitude A of the detected waveform Z of the ink drop sensor 7 reaches 80% of the amplitude A0 of the ideal waveform Z0 or until the timing of the detected waveform Z is within 0.5 μs from the ideal waveform Z0.

The steps S3-S6 described above are performed for each of the nozzles 47 provided on the recording head 3. That is, steps S3-S6 are sequentially performed for each of all nozzles 47 (22 lines×180 pieces); in other words, the flushing of the next nozzle 47 does not begin until the flushing of the current nozzle 47 is completed.

Using this process, it is possible to optimize the viscosity of the ink L retained in each of all nozzles 47. In addition, it is possible to minimize the number of times that the discharging operations are performed for each nozzle 47. In typical pre-print flushing process of the related art, the ink drops D are discharged from each of the nozzles 47, about 3,000 times in a uniform manner. In contrast, in the printer 1 of the present embodiment of the invention, the number of times that ink drops D are discharged can be decreased to less than 1,000 times per nozzle 47. Therefore, the printer 1 of the invention is capable of minimizing the amount of the ink L that is consumed during the flushing operation.

As described above, the control unit 60 conducts the pre-printing flushing operation for each nozzle 47 provided on the recording head 3. Then, after the completion of the pre-printing flushing operation, the paper-feeding mechanism 66 transports or feeds the sheet of recording paper into the printer 1. Then the operation terminates S7 and the printer 1 transitions into a recording stage where each of the nozzles 47 of the recording head 3 ejects the ink drops D toward the sheet of recording paper so as to print characters, images, and the like.

As explained above, the printer 1 of the invention acquires a detection signal or waveform Z from the ink drop sensor 7 during the pre-printing flushing operation, and then, using the detected signal, determines whether the printer should continue discharging the ink drops D or not. Using this configuration, the printer 1 of the invention avoids wasteful discharging of the ink drops D. In addition, since the printer 1 of the invention obtains information on the degree of viscosity of the ink L based on the amplitude A of the detected waveform Z acquired from the ink drop sensor 7 and/or the timing thereof, it is possible to reliably prevent any nozzle 47 from becoming clogged due to the thickening of the ink L.

Moreover, since the printer 1 of the present invention continues the flushing operation until the viscosity of the ink L in each nozzle 47 reaches an acceptable level, it is possible to prevent nozzle clogging with an increased reliability while efficiently avoiding any wasteful discharging of the ink L. Furthermore, since the previously described process is performed in each nozzle 47 of the recording head 3, it is possible to minimize the amount of the ink L that is consumed during the flushing operation.

If there is any nozzle 47 in which the ink L has thickened to a degree that is actually worse than the assumed "worst" viscosity conditions, the method and printer 1 of the present invention could increased the number of discharge operations as much as required, for example, more than 5,000 times. Although it is not possible to reduce the amount of the ink L that is consumed during these rare flushing operations, it is possible to more reliably clean the clogged nozzle 47. In the related art, when the flushing process is inadequate, it is necessary to conduct a burdensome cleaning process. In contrast, the printer 1 of the present invention offers an advantage in that it does require such a burdensome cleaning process.

Although various specific features are described above in the foregoing exemplary embodiments of the invention in order to explain preferred modes thereof, the invention should not be interpreted to be limited to the specific embodiments described above. The invention may be modified, altered, changed, adapted, and/or improved without not departing from the meaning or spirit of the invention as understood by a person skilled in the art. Thus, modifications from the explicit and implicit description made herein, including alterations, changes, adaptations, and/or improvements are also covered by the scope of the appended claims.

For example, although the flushing process explained above is a pre-printing flushing process, the specific type of flushing operation to which the invention is applied is not limited to pre-printing flushing operations. That is, the invention may be applied to any other flushing operations. Specifically, the invention is also applicable to, any periodical flushing operation that is performed periodically during a recording operation, any paper-feeding flushing operation performed as paper is fed into the printer, or any paper-eject flushing operation that is performed when the recording paper is ejected form the printer. If the invention is applied to the periodical flushing operation, the number of times that the ink-discharging operations are performed may be optimized to, for example, a few as a several dozens of executions. Consequently, it is possible to significantly shorten the duration of the periodical flushing operation. Therefore, it is possible to perform recording more efficiently because amount of time that the recording process is interrupted by the periodical flushing operation is reduced. The same advantage holds true when the invention is applied to the paper-feeding flushing operation and/or the paper-eject flushing operation. Since the number of times that the ink drops D are discharged decreases, meaning that the amount of the ink L consumed is reduced, which is particularly advantageous in the pre-printing flushing operation, when the amount of ink used is the largest. Thus, a greater advantage is obtained when the invention is also applied to other flushing operations such as the paper-feeding flushing operation or the paper-eject flushing operation.

Figure 11:
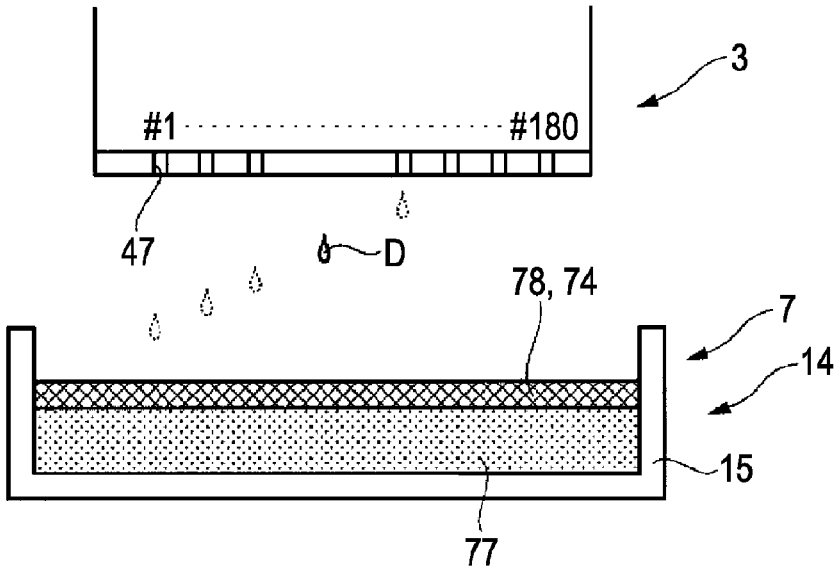
FIG. 11 is a schematic diagram illustrating another example of the order of discharging the ink drops according to an exemplary embodiment of the invention.

In the previously described configuration of the printer 1 the steps S3-S6 are subsequently performed for each nozzle 47 (22 lines×180 pieces=3,960 nozzles) provided on the recording head 3. However, the invention is not limited to such a specific configuration. FIG. 11 is a diagram that schematically illustrates another configuration that may be used. In this example, as illustrated in FIG. 11, one drop of the ink D is sequentially dropped from each of the 3,960 nozzles 47. Then, the thickness of the ink L is detected at each nozzle 47. Then, each of the 3,960 nozzles 47 sequentially discharge an additional drop of the ink D. This sequential discharging of the ink drops D continues the thickness state of the ink L in each of the nozzles 47 is monitored. Then, when the viscosity of the ink L in one nozzle 47 reaches the predetermined state, process ceases discharging ink drops D from that particular nozzle 47, while the process continues discharging ink drops D from any other nozzles 47 that have not yet reached the predetermined state. Accordingly, in this embodiment, the flushing operation of one nozzle 47 may finish earlier than for another nozzle 47 in which the thickness level of the ink L is greater, meaning that the nozzle 47 having the worst thickness is the last nozzle 47 to finish the flushing operation. This is unlike the configuration of the printer 1 originally described, wherein the series of the flushing steps S3-S6 are performed for each of the nozzles 47 are repeated until the process is completed for each individual nozzle.

One disadvantage of such a configuration is that if the entire flushing process takes a long period of time, there is a possibility that the ink L could become thickened gradually during the wait. In contrast, in the modified embodiment, the waiting time for the least-thickened nozzle 47 (i.e. the nozzle that completes the flushing operation first) is comparatively short. Therefore, one advantage of the modified configuration described is that the likelihood of gradual thickening of the ink L during the waiting time period is relatively low. It should be noted that the modification example described above is not limited to the above specific configuration in which just one drop of the ink D is discharged as a unit of the flushing operation. For example, a couple of the ink drops D, several ink drops D, or ten or dozens of ink drops D, though not limited thereto, may be discharged in each single execution of the flushing operation.

In the configuration of the printer 1 described above, the detected waveform Z of the ink drop sensor 7 is continually monitored from the start to the end of the flushing operation. However, the invention is not limited to this specific configuration, and as a non-limiting modification example thereof, the detected waveform Z of the ink drop sensor 7 may be acquired and monitored for a group of ink-discharging operations, such as ten ink-discharging operations. In another modification, it is possible to set the minimum number discharging operations based on the initially detected waveform Z of the ink drop sensor 7. For example, the thickness of the ink L may be categorized into a plurality of ranks, where each rank thereof is associated with a corresponding number of discharging operations. With such a configuration, it is possible to reduce the number of times of the detected waveform Z of the ink drop sensor 7 is acquired to once for each nozzle 47. In such a configuration, for confirmation, the ink drop sensor 7 may detect the last ink drop D only in order to confirm that the flushing operation was successful.

The number of times that the discharging operation is executed in the periodical flushing operation, the paper-feeding flushing operation, and the paper-eject flushing operation is, is typically smaller than that of the pre-print flushing operation. For example, the pre-print flushing operation is usually around three times the number used in the periodical flushing processing, the paper-feeding flushing processing, and the paper-eject flushing processes. Therefore, the number of times that the ink-discharging operations is performed in the periodical flushing process, the paper-feeding flushing process, and the paper-eject flushing process may be set based on the nozzle 47 with the worst thickness conditions during the pre-printing flushing process. Specifically, as each of the nozzles 47 sequentially discharges one drop of the ink D to detect the viscosity of the ink L the nozzle 47 that has the worst ink thickness conditions is selected. Then, the number of times of the ink drops D are discharged is set so as clean the nozzle 47 with the worst conditions. For example, it is determined that fifty ink-discharging operations are required for the worst nozzle 47, the remaining nozzles 47 discharge fifty ink drops D. In this configuration, it is possible to make the amount of ink drops D that are discharged smaller than in the typical flushing operation of the related art. In addition, since all of the nozzles 47 discharge the same number of ink drops D at the same time, it is possible to shorten the length of time taken for the execution of the flushing operation. Although, it should be noted that, the length of time taken for the execution of the flushing operation for this modification is still longer than that of the typical flushing operation of the related art because the ink drops D are discharged on a drop-by-drop basis, or one drop at a time. As described above, it is preferable to concurrently discharge the ink drops D from as many nozzles 47 as possible when a detection signal is not being acquired by the ink drop sensor 7.

In the embodiment of the invention originally described, the same single discharge pulse DP is used both for the flushing operation and the recording process. However, the invention is not limited to such a specific configuration. That is, the discharge pulse DP that is used during the flushing process may be changed in accordance with the detection signal of the ink drop sensor 7. For example, the driving voltage VD may be set relatively large for a certain nozzle 47 with a greater degree of ink thickness, whereas the driving voltage VD may be set smaller for another nozzle 47 with a smaller degree of ink thickness. In other words, when the flushing conditions are changed, the discharge pulse DP may also be changed in addition to the number of times of the discharging of the ink drops D. By this means, it is possible to shorten the length of time taken for the flushing operation.

Moreover, previously described embodiments of the invention, the cap member 15 of the capping mechanism 14 is used as the liquid drop catcher. However, the invention is not limited to this specific configuration. For example, a discrete liquid drop catcher that is dedicated specifically to inspecting ink-discharge may be used. Furthermore, in the configuration of the printer 1, it is explained that the electrode member 78 is electrically connected to the nozzle substrate 43 of the recording head 3 in such a manner that the electrode member 78 serves as a positive electrode and the nozzle substrate 43 of the recording head 3 serves as a negative electrode. However, the invention is not limited to such a specific configuration, and the positive side and the negative side of the electric connection described above may be reversed.

Furthermore, although the piezoelectric vibration element 38 is described as operating in a so-called vertical vibration mode, the invention is not limited to such a specific configuration, and in an alternative configuration, an alternative piezoelectric vibration element may be used that is capable of oscillating in an electric field direction, that is, can vibrate in the lamination direction of the piezoelectric substance (piezoelectric crystal) and an inner electrode. In addition, the piezoelectric vibration element 38 is not limited to one that is unitized for each nozzle line as described above. For example, a flexural-oscillation type piezoelectric vibration element, it may be provided for each of the pressure generation chambers 46. Further in addition, a variety of pressure generation elements may be used other than the piezoelectric vibration element described herein, such as heater elements and the like.

Moreover, the invention is described using an ink-jet printer as a non-limiting example of a recording apparatus in order to describe various aspects of the invention. However, the invention is not limited to such a specific configuration, and the invention is also applicable to, and may be embodied as, a variety of liquid ejecting apparatuses that eject or discharge a variety of liquids, including apparatuses that eject liquid other than ink. For example, the apparatuses may eject or discharge a fluid in which particles of a functional material is dispersed. As another example, it may eject or discharge a gel fluid. In addition to an ink-jet printer described above in the foregoing exemplary embodiment of the invention, liquid ejecting apparatuses to which the invention is applicable encompasses a wide variety of other types of apparatuses that ejects liquid or fluid wherein, for example, a color material or an electrode material is dispersed or dissolved, although the invention is not necessarily limited thereto. Herein, the color material may be, for example, one that is used in the production of color filters for a liquid crystal display device or the like. The electrode material or conductive paste may be, but is not limited to material used for electrode formation for an organic EL display device, a surface/plane emission display device (FED), and the like.

Furthermore, other liquid ejecting apparatuses to which the invention may be applied encompasses a wide variety of other types of apparatuses such as one that ejects a living organic material used for production of biochips or an apparatus that is provided with a sample ejection head which functions as a high precision pipette to eject a liquid sample. In addition, the invention is applicable to, and thus can be embodied as, a liquid ejecting apparatus that ejects, lubricating oil onto a precision instrument and equipment with high precision, including but not limited to a watch or camera. Moreover, the invention may be embodied as a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention may be embodied as a liquid ejecting apparatus that ejects an etchant such as acid or alkali that is used for the etching of a substrate or the like. Further in addition, the invention may be embodied as a liquid ejecting apparatus that ejects a gel fluid. Thus, the invention may be embodied as any one of the liquid ejecting apparatuses enumerated above, which constitute non-limiting examples of the applications and embodiments thereof, so long as liquid, regardless of whether it is in some liquid form or other fluid form, is ejected and thereby has any possibility of thickening and increasing the degree of the viscosity level of the liquid from drying or for any other reason.

What is claimed is:

1. A method for flushing a liquid ejecting apparatus by ejecting liquid from a nozzle of a liquid ejecting head toward a liquid catcher that is provided opposite to a nozzle opening surface of the liquid ejecting head without contacting the liquid ejecting head so as to prevent the clogging of the nozzles, the method comprising;

creating an electric field between the nozzle opening surface and the liquid catcher;

ejecting the liquid from the nozzle toward the liquid catcher;

detecting a change in voltage that is attributable to electrostatic induction generated when the liquid is ejected toward the liquid catcher; and determining whether to continue or discontinue the ejection of the liquid based on the detected change in voltage.

2. The method for flushing a liquid ejecting apparatus according to claim 1, wherein, determining whether to continue or discontinue the ejection of the liquid comprises obtaining information on the viscosity of the liquid in the nozzle based on detected change in voltage.

3. The method for flushing a liquid ejecting apparatus according to claim 2, wherein the information on viscosity of the liquid in the nozzle is obtained based on the amplitude and/or timing of the detected change in voltage.

4. The method for flushing a liquid ejecting apparatus according to claim 2, further comprising ejecting liquid from the liquid nozzle toward the liquid catcher and detecting the change in voltage that is attributable to electrostatic induction generated when the liquid is ejected toward the liquid catcher is repeated until the viscosity of the liquid retained in the nozzle is determined to be less than a predetermined level.

5. The method for flushing a liquid ejecting apparatus according to claim 4, the method is performed for each liquid nozzle in the liquid ejecting head.

6. The method for flushing a liquid ejecting apparatus according to claim 5, wherein the liquid is ejected from a first liquid nozzle until the viscosity of the liquid retained in the first nozzle is determined to be less than a predetermined level.

7. The method for flushing a liquid ejecting apparatus according to claim 5, wherein liquid is sequentially ejected a predetermined number of times from each liquid nozzle that has been determined to have a viscosity of liquid retained in the nozzle that is less than a predetermined level.

8. The method for flushing a liquid ejecting apparatus according to claim 1, wherein the method performed prior to beginning a process wherein liquid is ejected from the liquid ejecting head onto a liquid ejection target object.

9. The method for flushing a liquid ejecting apparatus according to claim 1, wherein the method is performed in a periodical flushing process that is performed during a liquid ejection process wherein liquid is ejected from the liquid ejecting head onto a liquid ejection target object.

10. The method for flushing a liquid ejecting apparatus according to claim 1, wherein the process is performed in a target-object-feed flushing process wherein a liquid ejection target object is fed into the liquid ejecting head, or in a target-object-eject flushing process wherein the liquid ejection target object is ejected from the liquid ejecting head.

11. A liquid ejecting apparatus capable of preventing clogging by performing flushing by ejecting liquid from a nozzle of a liquid ejecting head toward a liquid catcher that is provided opposite to a nozzle opening surface of the liquid ejecting without contacting the liquid ejecting head, the liquid ejecting apparatus comprising;

a liquid detecting section is capable of applying an electric field between the nozzle opening surface and the liquid catcher and detecting a change in voltage that is attributable to electrostatic induction generated when the liquid is ejected from the nozzle toward the liquid catcher; and a flushing section that is capable of ejecting the liquid from the liquid ejecting head toward the liquid catcher and determining whether to continue or discontinue the ejection of the liquid based on the of the detected change in voltage by the liquid detecting section.

12. The liquid ejecting apparatus according to claim 11, wherein the flushing section determines the viscosity of the liquid retained in the nozzle on the based on the detected change in voltage.

13. The liquid ejecting apparatus according to claim 12, wherein information on the state of thickness of the liquid retained in the nozzle is determined based on the amplitude and/or timing of the detected change in voltage.

14. The liquid ejecting apparatus according to claim 12, wherein the flushing section is further capable of ejecting liquid until the viscosity of the liquid retained in the nozzle is below a predetermined level.

15. A method for flushing a liquid ejecting apparatus by ejecting liquid from a nozzle of a liquid ejecting head toward a liquid catcher that is provided opposite to a nozzle opening surface of the liquid ejecting head without contacting the liquid ejecting head so as to prevent the clogging of the nozzles, the method comprising;

creating an electric field between the nozzle opening surface and the liquid catcher;

ejecting the liquid from the nozzle toward the liquid catcher;

detecting a change in voltage that is attributable to electrostatic induction generated when the liquid is ejected toward the liquid catcher;

obtaining information on the viscosity of the liquid in the nozzle based on detected change in voltage; and continuing the ejection of the liquid based on the obtained information on the viscosity of the liquid in the nozzle until the viscosity of the liquid retained in the nozzle is determined to be less than a predetermined level.

16. The method for flushing a liquid ejecting apparatus according to claim 15, the method is performed for each liquid nozzle in the liquid ejecting head.

17. The method for flushing a liquid ejecting apparatus according to claim 16, wherein the liquid is ejected from a first liquid nozzle until the viscosity of the liquid retained in the first nozzle is determined to be less than a predetermined level.

18. The method for flushing a liquid ejecting apparatus according to claim 16, wherein liquid is sequentially ejected a predetermined number of times from each liquid nozzle that has been determined to have a viscosity of liquid retained in the nozzle that is less than a predetermined level.

* * * * *